United States Patent [19]

Katona

[11] 4,043,091

[45] Aug. 23, 1977

[54] FLANGE MOUNT OVEN DOOR WINDOW

[75] Inventor: Joseph W. Katona, Walled Lake, Mich.

[73] Assignee: Mills Products, Inc., Farmington, Mich.

[21] Appl. No.: 693,082

[22] Filed: June 4, 1976

[51] Int. Cl.[2] ..... F23M 7/00

[52] U.S. Cl. ..... 52/616; 126/200

[58] Field of Search ..... 52/616, 304, 399; 126/200, 198

[56] References Cited

U.S. PATENT DOCUMENTS

| | | | |
|---|---|---|---|
| 2,269,506 | 1/1942 | Andersson | 126/200 UX |
| 2,319,004 | 5/1943 | Lotter | 126/200 |
| 2,325,773 | 8/1943 | Hennessy | 126/200 |
| 2,993,242 | 7/1961 | Leisibach | 52/304 |
| 3,418,779 | 12/1968 | Jendrisak et al. | 52/616 |
| 3,577,973 | 5/1971 | Katona | 52/616 X |
| 3,659,582 | 5/1972 | Morgan | 52/616 X |

*Primary Examiner*—J. Karl Bell

*Attorney, Agent, or Firm*—Whittemore, Hulbert & Belknap

[57] ABSTRACT

A self-contained flange mount window unit adapted to be assembled in an oven door. The windor unit comprises a pair of glass panes held in spaced parallel relation by a substantially continuous frame-spacer of integral one-piece construction which is made from an elongated member that is bent to substantially rectangular final form and is retained in final form by a tab at one end engaging a slot at the other end. The frame-spacer has an integral mounting flange projecting laterally outwardly from the top, bottom and sides of the window unit. The window unit is secured to the back panel of the oven door by fasteners which pinch the mounting flange between the air baffle of the door and the clamping surfaces of a plurality of bridge spacer members.

7 Claims, 4 Drawing Figures

FLANGE MOUNT OVEN DOOR WINDOW

SUMMARY OF THE INVENTION

The window unit of this invention is a self-contained economical window unit consisting of three parts, namely, two glass panes and a frame-spacer of integral one-piece construction for securing the panes together in spaced parallel relation.

The frame-spacer has an integral mounting flange by means of which the window unit may be mounted in the door. No expensive or other attaching devices are required.

The frame-spacer is initially an elongated member which is pre-noted so that it may be bent into the required rectangular form. One end of the member has a tab which engages a slot in the other end to retain the member in rectangular form. The tab may be held in the slot by folding it over. Alternatively the tab may have a detent which flexes to permit it to be inserted but prevents its subsequent withdrawal.

Other objects and features of the invention will become more apparent as the description proceeds, especially when taken in conjunction with the accompanying drawings wherein.

Figure 1:
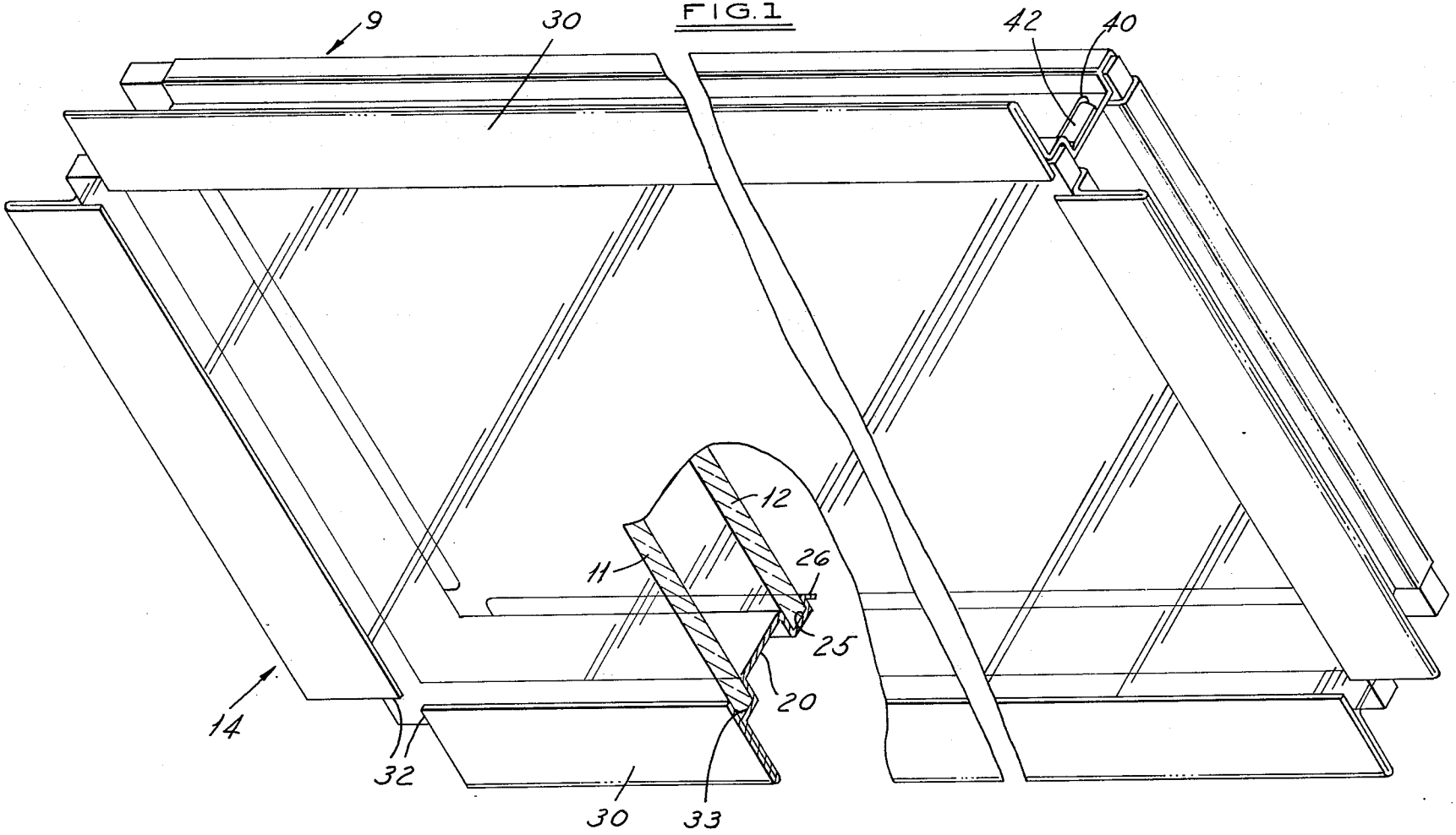
FIG. 1 is a fragmentary view with parts broken away and in section of a self-contained window unit embodying the invention.

Referring now more particularly to the drawings, the self-contained window unit 9 has a pair of rectangular glass panes 11 and 12 secured together and retained in spaced parallel relation by a substantially continuous rectangular frame-spacer 14. The pane 12, which, when the window unit is mounted in the door, is at the oven side, may be formed for example from tempered, coated or other heat resistant glass. The pane 11 which is at the kitchen side, may be formed for example of raw, tempered or coated glass.

Figure 2:
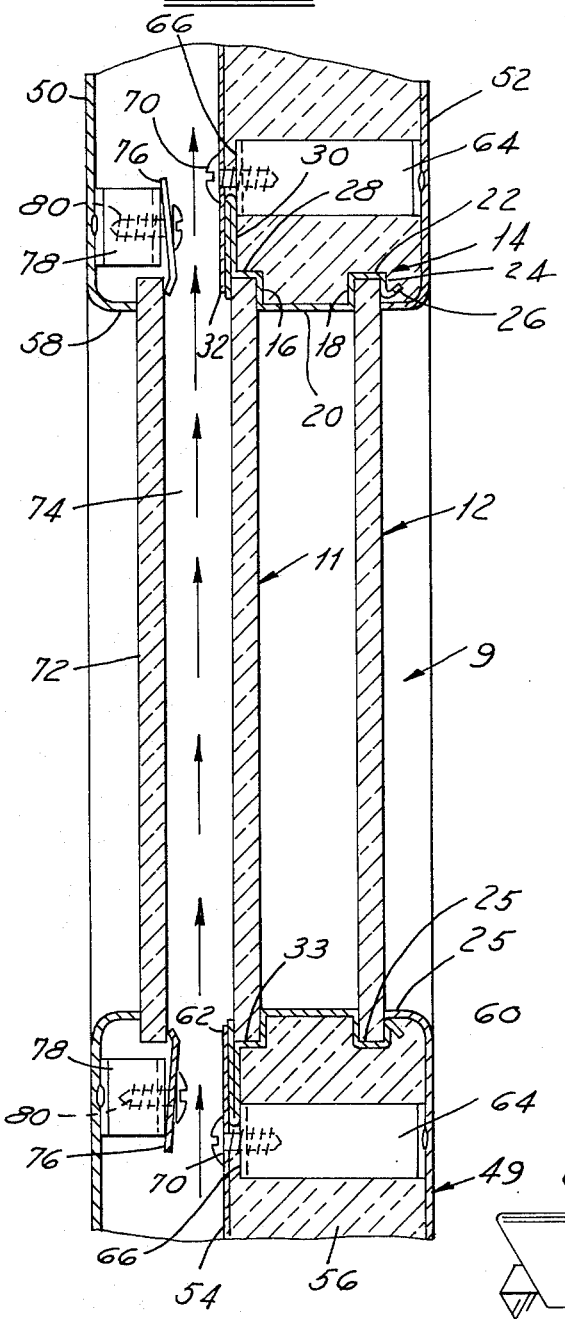
FIG. 2 is a fragmentary vertical sectional view showing the self-contained window mounted in an oven door.

The frame-spacer 14 is roll-formed to the configuration shown in FIGS. 1 and 2 from an elongated piece of flat stock preferably metal. Thus the frame-spacer has a central portion of channel-shaped cross section having the spaced parallel side walls 16 and 18 extending outwardly from the opposite edges of the web 20. The outwardly extending side wall 18 is bent rearwardly to provide the wall 22 which is parallel to web 20. A wall or flange 24 extends inwardly from the wall 22 in spaced parallel relation to the side wall 18 and terminates in an angled pilot flange 26. Walls 18, 22 and 24 provide a glass-receiving channel 25.

The side wall 16 is bent forwardly to provide the wall 28 disposed in the same plane as the wall 22, and this wall 28 is then turned outwardly parallel to side wall 16 and then folded inwardly upon itself to provide the mounting flange 30. The terminal flange portion 32 of the folded portion extends inwardly beyond the wall 28 so that the terminal flange portion 32 and walls 16 and 28 provide a glass-receiving channel 33.

The parts 16, 18 and 20 of the frame-spacer 14 constitute the spacer portion, and the parts 22, 24, 28 and 32 constitute the frame portions.

The elongated member from which the frame-spacer is made is pre-notched in the flat, that is before it is roll-formed, at three points corresponding to three corners of the rectangular frame-spacer so that it may be hand bent to such rectangular configuration. The notching extends inwardly from both side edges up to but not including the web 20, it being understood that the web 20 does not have to be notched to permit bending to rectangular shape.

One end of the frame-spacer is provided with a slot 40 in the web portion 20. The other end is formed with a tab 42 which extends from the web portion and is adapted to extend through the slot 40 after which it may be bent over as shown in FIG. 1 to retain the frame-spacer in its rectangular form supporting the two glass panes in spaced parallel relation. The slot 40 and tab 42 may be formed at the same time as the member is pre-notched.

As shown in FIGS. 1 and 2, the channels 25 and 33 receive the peripheral edge portions of the glass panes 11 and 12 to hold them securely in spaced parallel relation. The side walls 16 and 18 engage the inner surfaces of the two glass panes adjacent the peripheries thereof along the four sides of the panes. The walls 22 and 28 extend across and engage the peripheral edges of the two glass panes along the four sides thereof. The flanges 24 and 32 engage the outer surfaces of the glass panes adjacent their peripheries along the four sides thereof. The channels 25 and 33 are interrupted or notched at the corners. The mounting flange 30 is also interrupted or notched at the corners, but extends outwardly along each of the four sides of the window unit parallel to the glass panes.

In assembling the two glass panes 11 and 12 and the frame-spacer 14 to form the self-contained window unit 9, the spacer-frame, pre-bent at three points corresponding to three corners of the window unit, is placed about the two glass panes with the peripheral edge portions of the latter in the channels 25 and 33 of the spacer-frame. The tab 42 is inserted in the slot 40, and the tab is bent over by the use of a hammer or any suitable tool to provide a permanent assembly of the parts.

FIG. 2 illustrates the window unit installed in an oven door 49 which includes a front door panel 50, a rear door panel or liner 52 and a centrally disposed baffle 54. The baffle 54 is adapted to retain insulating material 56 between the baffle and the rear panel 52. The front door panel 50 has a rectangular rearwardly turned flange 58 and the rear panel 52 has a rectangular forwardly turned flange 60. The baffle 54 has a rectangular aperture 62. The apertures defined by the flanges 58 and 60 of the door panels 50 and 52 are aligned with the aperture 62 in the baffle 54 and constitute the window opening of the oven door.

The window unit 9 is installed in the oven door between the rear panel 52 and the baffle 54 with the edge of the flange 60 of the rear panel engaging the rear surface of the glass pane 12 along the four sides of the pane adjacent its periphery. The angled flange 26 on the frame-spacer 14 acts as a pilot to facilitate location of the window unit with respect to the aperture in the rear door panel. In the assembled position of the window unit as shown in FIG. 2, the inner marginal portion of the baffle 54 overlaps and engages the front surface of the mounting flange 30. along all four sides of the window unit.

Brackets or bridge spacers 64 are provided as part of the structure for securing the window unit 9 in the door.

These brackets 64 are welded or otherwise permanently secured to the rear door panel 52 and have coplanar clamping surfaces 66 which engage the rear surfaces of the mounting flange 30. Headed fasteners or screws 70 extend through holes in the baffle and thread into the bridge spacers 64 to clamp the baffle 54 against the mounting flange 30 and thereby pinch the mounting flange 30 between the baffle 54 and the clamping surfaces 66 of the bridge spacers 64.

FIG. 2 shows one bridge spacer 64 and screw 70 at the top of the window unit and one at the bottom. Actually, there may be more than one such bridge spacer along both the top and bottom of the window unit. Likewise, one or more of such bridge spacers and screws may also be provided along each side of the window unit to pinch the side portions of the mounting flange between the baffle 54 and the clamping surfaces 66 in the same relationship of the parts as is shown in FIG. 2.

To complete the window assembly, a glass pane 72, of the same size and shape and preferably of the same material as the pane 11, is secured to the front door panel 50 in spaced parallel relation to the pane 11 to define an air passage 74 therebetween communicating with suitable air inlets and outlets, not shown, along the top and bottom edges of the door. The pane 72 is clamped against the flange 58 of the front panel 50 along its four sides adjacent the periphery thereof by clips 76 secured to brackets 78 by screws 80. The brackets 78 are secured to the front panel 50 by any suitable means such as by welding.

Figure 3:
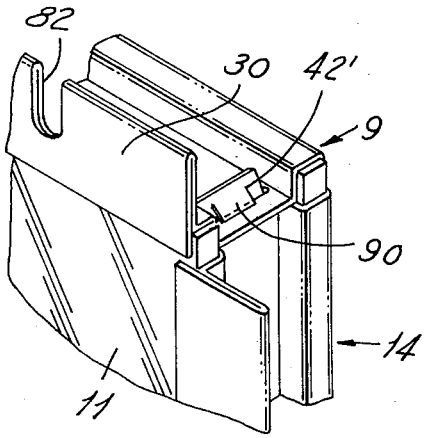
FIG. 3 is a fragmentary perspective view showing a modification.
Figure 4:
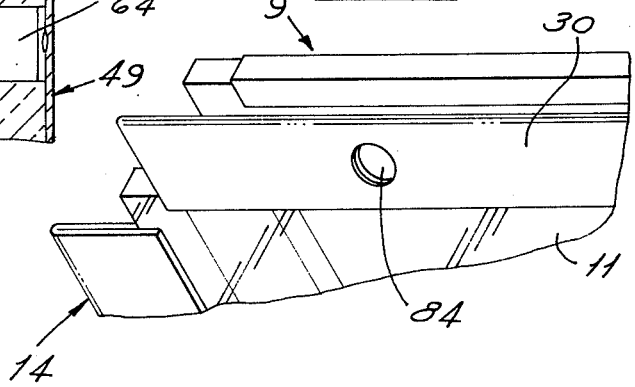
FIg. 4 is a fragmentary perspective view showing a further modification.

FIG. 3 shows a modification of the invention in which a recess in the form of a slot 82 is shown in the mounting flange 30 extending inwardly from the outer edge thereof. The slot 82 is provided to clear the shank of a mounting screw 70 in instances where the associated bridge spacer 64 is located nearer to the window opening than shown in FIG. 2. FIG. 4 shows a further modification in which, instead of slots, the recesses take the form of one or more circular holes 84 in the mounting flange 30 adjacent to its outer edge for receiving the shank of a screw 70 in instances where the associated bridge spacer is located closer to the window opening than shown in FIG. 2. Such slots or holes may be provided where necessary for each of the bridge spacers.

Referring again to FIG. 3, a further modification is shown in which the tab 42' differs from the tab 42 in that it has a detent 90. The detent 90 is an integral part of the tab and is formed to a rectangular shape by cutting along three sides as indicated and then bending the tab outward at a slight angle as shown. The uncut side of the tab is that side adjacent to the leading edge of the tab so that when the tab is inserted in the slot 40 the detent 90 may flex inward to pass through the slot after which it will spring back to its natural position shown in FIG. 3 in which the overall width of the tab and detent is greater than the width of the slot to prevent the tab from being withdrawn. With this construction, it is not necessary to hammer the tab over to secure the connection. If it should be desired to disassemble the window unit, this can be done by pressing the detent 90 flat so that it will clear slot 40 and permit the tab to be withdrawn.

The mounting of the window unit 9 may be accomplished without the presence of the baffle 54. If the baffle 54 is omitted, then the mounting flange will be pinched between the head of the screw 70 and the clamping surface 66 of each bridge spacer. The heads of the screws may be enlarged for this purpose if desired since only one side of the screw, as shown in FIG. 2, would clamp the outer edge of the mounting flange. It will be just as clearly understood that the clamping of the window unit to the bridge spacers may be accomplished without the baffle 54 in instances where the mounted flange is slotted (FIG. 3) or has circular holes (FIG. 4) for receiving the shanks of the screws because in those instances the heads of the screws will bear directly upon the mounting flange. However, the air baffle 54 is desired as part of the clamping structure because, due to the fact that it is relatively stiff, it provides a strong clamp to pinch the mounting flange 30 against the clamping surfaces of the bridge spacers. This clamping pressure of the baffle is applied to the mounting flange not only at the bridge spacers but also along the length of the mounting flange between the bridge spacers.

What I claim as my invention is:

1. A self-contained flange mount window unit adapted to be assembled into an oven door having front and back door panels with aligned window openings, comprising a pair of glass panes, and retaining means for said panes comprising a substantially continuous frame-spacer extending along the top, bottom and side peripheral edge portions of said panes and holding the same in spaced parallel relation, said frame-spacer having a laterally outwardly projecting mounting flange by means of which said window unit may be mounted in the oven door, said frame-spacer including its flange being of unitary one-piece construction having a spacer portion engaging the inner peripheral surfaces of said panes and frame portions engaging the peripheral edges and outer peripheral surfaces of said panes, said mounting flange extending laterally outwardly from that part of one of said frame portions which engages the peripheral edge of one of said panes and being folded upon itself so as to extend laterally inwardly beyond the peripheral edge of said one pane to provide that part of said one frame portion which engages the outer peripheral surface of said one pane, and means engaging the folded portions of said mounting flange to mount the same to the oven door.

2. A self-contained flange mount window unit adapted to be assembled into an oven door having front and back door panels with aligned window openings, comprising a pair of glass panes, and retaining means for said panes comprising a substantially continuous frame-spacer extending along the top, bottom and side peripheral edge portions of said panes and holding the same in spaced parallel relation, said frame-spacer having a laterally outwardly projecting mounting flange by means of which said window unit may be mounted in the oven door, said frame-spacer including its flange being of unitary one-piece construction having a spacer portion engaging the inner peripheral surfaces of said panes and frame portions engaging the peripheral edges and outer peripheral surfaces of said panes, and means for securing said window unit in the oven door in alignment with the window openings therein comprising a member secured to one of the door panels having a clamping surface, and means clamping said mounting flange to said clamping surface, said clamping means including a fastener having a head pinching said mounting flange to said clamping surface.

3. A window unit as defined in claim 2, wherein said flange has a recess to accommodate the shank of said fastener.

4. A window unit as defined in claim 2, wherein said flange has a slot in its outer edge to accommodate the shank of said fastener.

5. A window unit as defined in claim 2, wherein said flange has a hole to accommodate the shank of said fastener.

6. A self-contained flange mount window unit adapted to be assembled into an oven door having front and back door panels with aligned window openings, comprising a pair of glass panes, and retaining means for said panes comprising a substantially continuous frame-spacer extending along the top, bottom and side peripheral edge portions of said panes and holding the same in spaced parallel relation, said frame-spacer having a laterally outwardly projecting mounting flange by means of which said window unit may be mounted in the oven door, said frame-spacer including its flange being of unitary one-piece construction, said door having an air baffle between the front and rear door panels provided with a window opening aligned with the window openings in the front and rear panels, the inner margin of said air baffle overlapping one side of said mounting flange, and means for securing said window unit in the oven door in alignment with the window openings therein comprising a member secured to one of the door panels having a clamping surface, and a fastener pinching said mounting flange between said inner margin of said air baffle and said clamping surface.

7. A window unit as defined in claim 6, wherein said inner margin of said air baffle overlaps the front side of said mounting flange, said member is a bridge spacer member a plurality of which are provided and secured to the back door panel so that their clamping surfaces are coplanar, said fastener as well as one or more additional fasteners pinching said mounting flange between said inner margin of said air baffle and said clamping surfaces.

* * * * *